US006267183B1

(12) United States Patent
Smagac

(10) Patent No.: US 6,267,183 B1
(45) Date of Patent: Jul. 31, 2001

(54) FIRE SUPPRESSANT FOAM GENERATION APPARATUS

(75) Inventor: Dennis Edward Smagac, Boulder, CO (US)

(73) Assignee: Intelagard, Inc., Boulder, CO (US)

( * ) Notice: Subject to any disclaimer, the term of this patent is extended or adjusted under 35 U.S.C. 154(b) by 912 days.

(21) Appl. No.: 08/786,974

(22) Filed: Jan. 24, 1997

Related U.S. Application Data

(63) Continuation of application No. 08/448,808, filed on May 24, 1995, now Pat. No. 5,623,995.

(51) Int. Cl.[7] ..... A62C 35/00; A62C 11/00; A62C 15/00; B01F 5/06

(52) U.S. Cl. ..... 169/30; 169/43; 169/9; 169/13; 169/14; 169/30; 169/71; 169/85; 239/152; 366/336

(58) Field of Search ..... 169/9, 13, 14, 169/15, 30, 43, 44, 46, 52, 71, 85, 86, 88; 239/152, 153, 154; 366/336, 337

(56) References Cited

U.S. PATENT DOCUMENTS

| | | | |
|---|---|---|---|
| 3,255,824 | 6/1966 | Rodgers | 169/77 |
| 3,337,195 | 8/1967 | Farison | 261/27 |
| 3,342,271 | 9/1967 | Anthony, Jr. | 169/15 |
| 3,592,269 | 7/1971 | Stults | 169/9 |
| 3,721,299 | 3/1973 | Roessler | 169/77 |
| 3,802,511 | 4/1974 | Good, Jr. | 169/30 |
| 4,093,188 | 6/1978 | Horrer | 366/336 |
| 4,254,833 | 3/1981 | Perry | 169/76 |
| 4,981,178 | 1/1991 | Bundy | 169/9 |
| 5,255,747 | 10/1993 | Teske et al. | 169/15 |

FOREIGN PATENT DOCUMENTS

| | | |
|---|---|---|
| 2246294 | 1/1992 | (GB) . |
| 94/07570 | 4/1994 | (WO) . |

*Primary Examiner*—Christopher P. Ellis
*Assistant Examiner*—Jeffery A. Shapiro
(74) *Attorney, Agent, or Firm*—Duft, Graziano & Forest, P.C.

(57) ABSTRACT

The fire suppressant foam generation and application apparatus comprises a backpack mounted unit that produces a low moisture content fire suppressant foam for use in fire fighting applications. This apparatus draws fire suppressant foam concentrate from a reservoir mounted on the backpack and injects pressurized gas into the flow of the fire fighting foam concentrate to create the fire suppressant foam. The pressurized gas drives the fire suppressant foam through a delivery apparatus where the fire suppressant foam is agitated as it passes through the delivery apparatus to expand the foam and reduce the moisture content. A pressurized gas operated pump can be used to actively draw the water/foam mixture from a supply tank and supply it under pressure to the delivery apparatus, which can be a hose that is equipped with a nozzle.

15 Claims, 10 Drawing Sheets

FIRE SUPPRESSANT FOAM GENERATION APPARATUS

CROSS REFERENCE TO RELATED APPLICATION

This application is a continuation of U.S. patent application Ser. No. 08/448,808 titled "Fire Suppressant Foam Generation Apparatus," filed May 24, 1995 issued as U.S. Pat. No. 5,623,995.

FIELD OF THE INVENTION

This invention relates to fire fighting apparatus and, in particular, to apparatus for generating and delivering a fire suppressant foam for use in fire fighting.

PROBLEM

It is a problem in the field of fire fighting to provide a sufficient volume of fire fighting material to suppress a fire. The traditional fire fighting material used for this purpose is water, which has the undesirable side effect of causing a significant amount of water damage to the real property in and around the area in which the fire is engaged. In fact, in many situations the water damage to the real property is significantly in excess of the fire damage to the real property. An alternative fire fighting material in use is fire suppressant foam. However, the difficulty with fire suppressant foam is that the typical materials used for this purpose require complicated mixing and pumping apparatus and still produce a significant amount of water damage due to the relatively high water content of the foam.

In a typical application, the availability of a significant water supply renders water as a fire fighting material the desired choice, since the fire suppressant foam itself requires a significant amount of water. In addition, fire suppressant foam requires complicated generation and delivery apparatus, thereby rendering it impractical for use except in certain selected applications, such as airport fire fighting applications where the use of water is ineffective in controlling the magnitude and extent of a fuel fire. There presently does not exist any apparatus that is effective in fire fighting applications that is simple in architecture and yet causes minimum ancillary damage to real property as a result of the fire suppression activity.

Rural homeowners face additional problems in protecting their property from the danger of wildfires. There is an increasing trend for people to build their homes in locations that are within what is called the wildland/urban interface. This is a term that describes the geographical areas where formerly urban structures, mainly residences, are built in close proximity to flammable fuels naturally found in wildland areas, including forests, prairies, hillsides and valleys. To the resident, the forest represents a beautiful environment but to a fire the forest represents a tremendous source of fuel. Areas that are popular wildland/urban interfaces are the California coastal and mountain areas and the mountainous areas in Colorado (among others).

Residences built in these areas tend to be placed in locations that contain significant quantities of combustible vegetation and the structures themselves have combustible exterior walls and many have untreated wood roofs. Many of these houses are also built on sloping hillsides to obtain scenic views; however, slopes create natural wind flows that increase the spread of a wildfire. These homes are also located a great distance away from fire protection equipment and typically have a limited water supply, such as a residential well with a minimal water flow in the range of one to three gallons per minute. Therefore, residences located in the wildland/urban interface do not have access to an adequate supply of the traditional fire suppressant material—water. Thus, traditional fire fighting technology has severe limitations in terms of its effectiveness and availability in many applications.

SOLUTION

The above described problems are solved and a technical advance achieved in the field by the fire suppressant foam generation and application apparatus of the present invention. This apparatus makes use of a commercially available low moisture content fire suppressant foam mixture in conjunction with novel foam generation and application apparatus to minimize the water damage to real property caused by the fire suppression activity. This apparatus is simple in structure and operation and makes use of a pressurized gas to create the water/foam mixture, propel it through the delivery apparatus and, in one embodiment, power an auxiliary pump to increase the delivery pressure of the fire suppressant materials. This apparatus is lightweight in construction, simple in architecture and can be implemented in a unit that is sufficiently compact to be installed on a lightweight utility vehicle, such as a four-wheel drive pick-up truck or implemented in the form of a backpack unit. This apparatus also does not require a large capacity source of water to create the fire suppressant materials that are applied to the fire since the foam generation apparatus provides a significant expansion to the foam/water concentrate.

In one embodiment, a source of pressurized gas, such as nitrogen, is used to supply the propellant. The nitrogen is applied via a pressure regulator to a supply line that joins with an outlet line from the water/foam mixture supply tank. The pressurized nitrogen supplies a foaming action as the water/foam mixture is driven down the pipe and also forces the resultant foam through the delivery apparatus, such as a conventional fire hose. Interposed in the delivery apparatus between the fixture and the outlet end of the hose is a mixing apparatus, termed "stata tube", which functions to significantly increase the foam expansion prior to delivery of the foam through the delivery apparatus. The stata tube comprises an exterior housing inside of which is mounted a set of motionless mixing blades that function to mix and expand the foam. The stata tube not only produces a high expansion of the foam but it also produces a more consistent bubble structure which enhances both the longevity and adhesion of the foam when applied to a structure.

An alternative embodiment makes use of a pressurized gas operated pump that can be driven by an auxiliary supply of pressurized gas, such as an air compressor, to supply the water/foam mixture to thereby conserve the pressurized nitrogen for use in the creation of the fire suppressant foam.

The water/foam mixture uses commercially available foaming agents that are expanded by the application of the pressurized gas and the use of the stata tube to create the fire suppressant foam without the need for pressurized water as a propellant. This has multiple benefits, including the reduction in the moisture content of the fire suppressant foam and avoiding the need for complex water pumping apparatus to create the stream of pressurized water. The elimination of water as a delivery agent thereby renders this apparatus independent of a large supply of water that is typically needed for fire fighting purposes. In addition, since water is an incompressible medium, its storage and delivery cannot be improved by pressurization, whereas the use of an inert gas such as nitrogen provides great opportunity for storage efficiency since the gas can be pressurized to extremely high levels, thereby efficiently storing a vast quantity of propellant in a small physical space. Similarly, the use of a pressurized gas powered pumping system to increase the pressure of the delivered water/foam mixture does not unduly complicate the apparatus since pumps of low weight and size are available for this purpose. The resultant apparatus is therefore extremely lightweight, compact in dimensions and inexpensive to implement. Control of the flow of the pressurized gas and water/foam mixture is accomplished by way of simple check valves and pressure regulators, thereby eliminating the complex apparatus presently in use. Use of a water/foam mixture as a fire fighting material is beneficial, since a small quantity of the mixture expands to produce a tremendous volume of fire fighting material. Therefore, a significant volume of fire fighting materials can be created using a small quantity of water/foam mixture and a compact source of pressurized gas. This novel apparatus can therefore be implemented inexpensively in a compact implementation unknown in the prior art.

DETAILED DESCRIPTION

There is an increased incidence of home building in the area defined as the wildland/urban interface. This area is where residences are built in close proximity to the flammable fuels naturally found in wildland areas, including forests, prairies, hillsides and valleys. These areas typically represent the confluence of a plurality of factors that render fire fighting difficult, if not impossible. The primary factor is combustible vegetation which is found in abundance in these areas. An approaching fire ignites the surrounding vegetation in a step by step attack on a home and may reach intensities that render conventional fire fighting methods ineffectual. In particular, when the fire reaches an intensity of 500 btu per foot of fire line front per second of burning, the fire is considered to be beyond control by use of organized means. Beyond 1000 btu per foot per second a fire can be expected to feature dangerous spotting, fire whirls, crowning and major runs with high rates of spread and violent fire behavior, such a tornado-like winds. Spotting is particularly difficult to deal with since it occurs as wind borne burning embers are carried far ahead of the main fire front. These embers land in receptive fuels and can fall on the roof of a home or a woodpile and start new fires far in advance of the fire line front.

In addition, many of the structures built in these rural areas are constructed of materials that are of highly susceptible to fires. Primary among these are untreated wood roofs such as untreated wood shingles or wood shake roofing. Furthermore, these structures have combustible exterior walls or affiliated wood structures such as decks and woodpiles located under decks or placed too close to the structure. Many of the structures are located on a slope which creates a natural wind flow that increases the speed of a wildfire by creating a chimney effect. The remote location of these structures impedes the ability of fire fighting equipment to reach the site of a fire. Finally, there is typically a significant lack of water available for fire fighting purposes. There are no hydrants or ponds and a fire tanker truck must respond to the site of the fire in order to provide a source of water for fire fighting purposes. These structures typically have a domestic water supply that consists of a well of limited volumetric capacity. Therefore, the confluence of many or all of these factors make fire fighting in this environment difficult at best.

Traditional fire fighting may be somewhat ineffectual in the wildland/urban interface but is successful in other residential applications. However, a problem with the use of water as a fire suppressant material is that it causes significant ancillary damage to a residence and its contents as a result of fire fighting activity. Therefore, it is desirable to find an alternative fire suppressant material.

Theory of Operation

Figure 1:
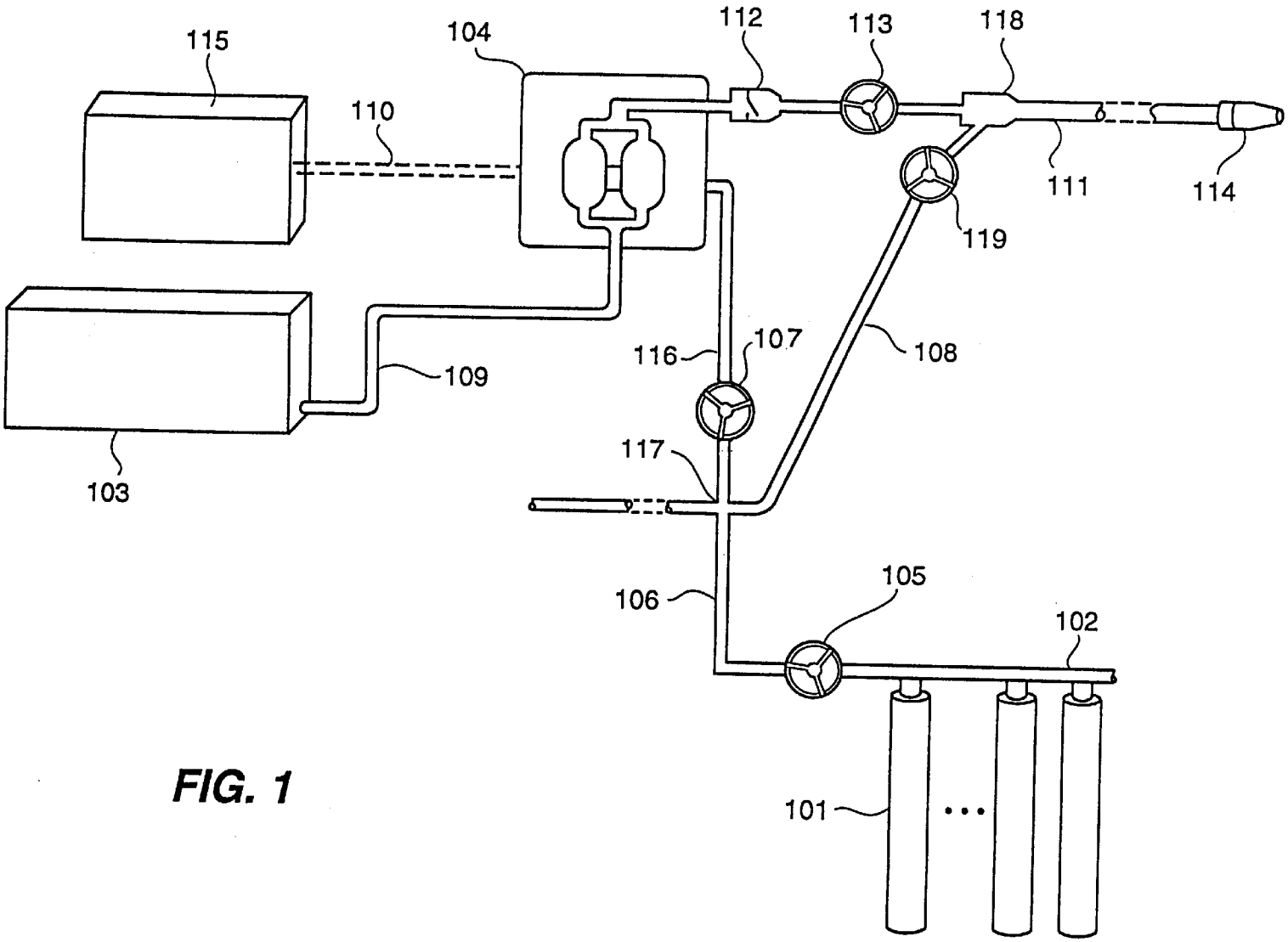
FIG. 1 illustrates in block diagram form the overall architecture of the fire fighting foam generation system of the present invention.
Figure 17:
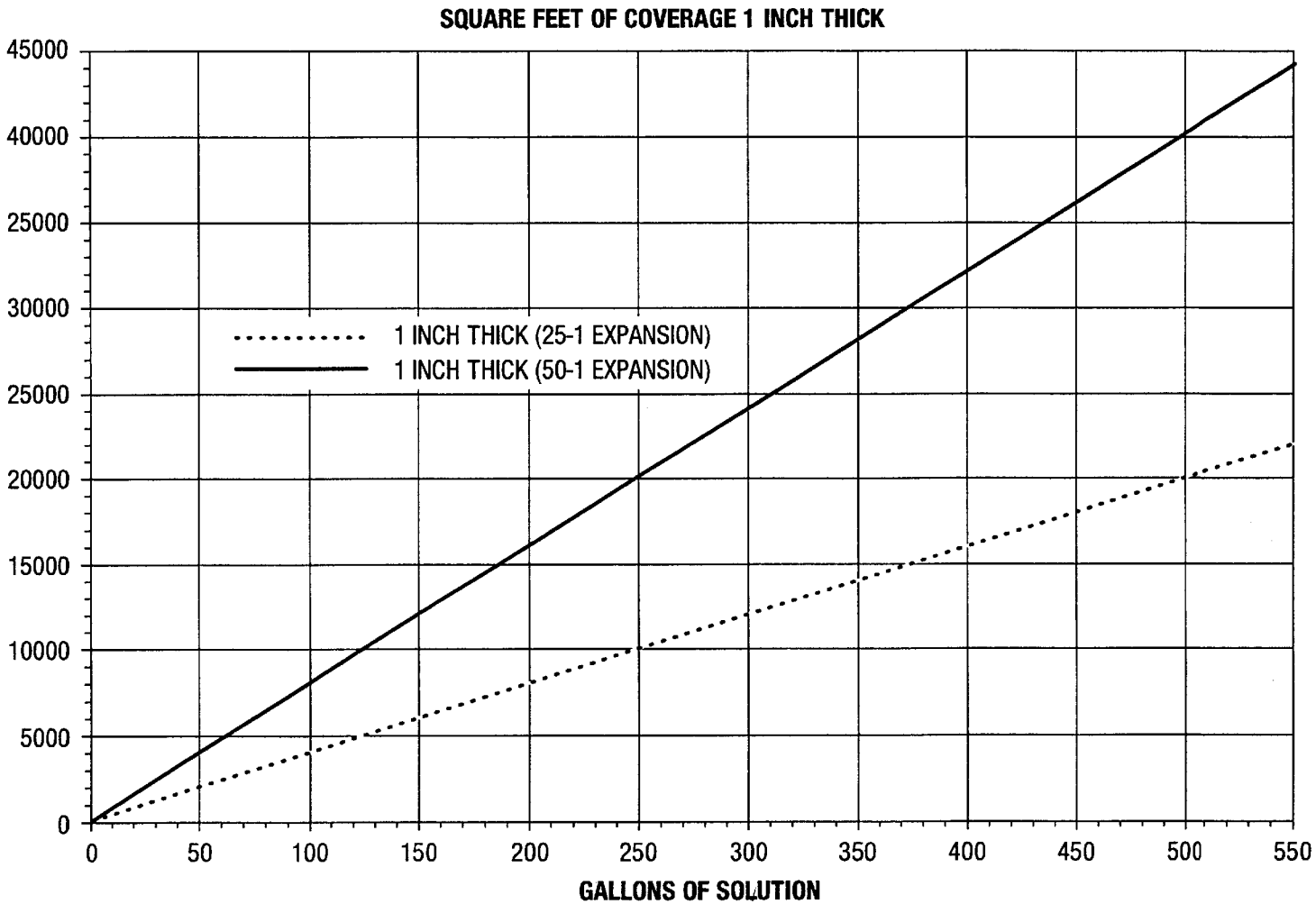
FIG. 17 illustrates a chart of coverage capability of the foam.

FIG. 1 illustrates in block diagram form the overall architecture of the fire suppressant foam generation and application apparatus of the present invention. Fire suppressant foam is a combination of a fluid/foam mixture and a propellant which functions to both agitate the fluid/foam mixture to create the expanded foam and to deliver it through the application apparatus to the fire. The fire retardant foam generation and application apparatus produces a dry fire suppressant foam mixture for use in fire fighting applications. The reduction in the fluid content of the fire suppressant foam is accomplished by the use of pressurized gas in place of a fluid to create the agitation and pressurized delivery capability. Furthermore, the use of the pressurized gas eliminates the need for a large complex pumping apparatus to pump an incompressible fluid, such as water, that has been used in the past to agitate and supply the foam mixture to the spray nozzles. A hydraulic or pressurized gas operated pump can be used to actively draw the water/foam mixture from a supply tank and supply it under pressure to the outlet line where it is mixed with and agitated by the pressurized gas to create the resultant foam. In a typical application, a 200 gallon tank of water/foam mixture can produce 10,000 gallons of water-based biodegradable foam without the need of complex pumping apparatus. The coverage provided by this foam is illustrated by the chart of FIG. 17. As is evident from this chart, a small amount of fire suppressant foam fluid covers a significant area. The significant expansion of the foam is obtained by the use of the stata tube which provides dramatic results in terms of agitating the fire suppressant foam liquid to produce the resultant bubble structure in the foam.

In this option, the use of the nitrogen gas has multiple benefits since the nitrogen gas is an inert element and does not support fire. One gallon of foaming concentrate is used for 320 gallons of water and, when mixed with high pressure air or nitrogen gas, a tremendous expansion of the foaming material takes place in the stata tube to create the fire suppressant foam. This fire suppressant foam functions to extinguish the fire by means of a number of different characteristics. The small amount of detergent in the foaming agent enables the water to overcome the surface tension created by oils and dust normally found on interior and exterior surfaces. This allows the foam to penetrate and wet the flammable materials that comprise the structure much more quickly than the application of water alone. Also, because the foam is able to soak into the wood and vegetation instantly, evaporation is much less of a problem than the use of water that tends to pool on surfaces. The foam bubbles at the bottom of the foam wet and cool the surface that is to be protected. Furthermore, the top layer of the foam bubbles to provide a lingering cooling cover of oxygen-free insulation and heat reflection. The nitrogen gas that permeates the fire suppressant foam starves the fire of oxygen, therefore retarding the spread of the fire to the materials on which the foam has been applied. The foam therefore penetrates, cools and smothers the fire while the water would simply run off or evaporate in a similar application.

Thermal and Temporal Dynamics

Figure 11:
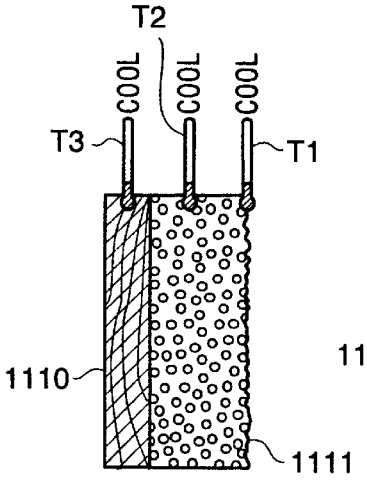
FIGS. 11–16 illustrate a cross-section view time-ordered sequence of cross-section views of the temporal and temperature characteristics of the fire suppressant foam generation apparatus of the present invention as applied to a combustible material.

A brief description of the temporal and thermal dynamics of the fire fighting foam is appropriate to thereby understand the benefits afforded by the various embodiments of the fire fighting foam generation apparatus disclosed herein. FIGS. 11–16 illustrate in cross-section view a temporal sequence of the temperature responsiveness of a combustible material overcoated with the fire suppressant foam generated by the apparatus of the present invention. In particular, section 1110 is a thickness of combustible material, such as a shed wall, typically made of laminated plywood or composition board. A thickness of fire fighting foam 1111 has been applied to the exterior surface of the combustible material 1110 to provide a barrier to a fire which would engulf the structure of which the combustible material 1110 is a part. The thermometer symbols T3–T1 indicate the relative temperature of the interior of the combustible material 1110, the interior of the fire fighting foam 1111 and the exterior, exposed surface of the fire fighting foam 1111, respectively. FIG. 11 illustrates the state of this combination prior to the arrival of the fire, with all layers being at a steady state ambient temperature.

Figure 12:
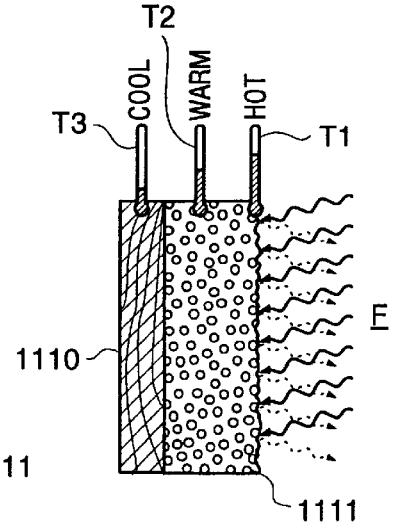
Figure 13:
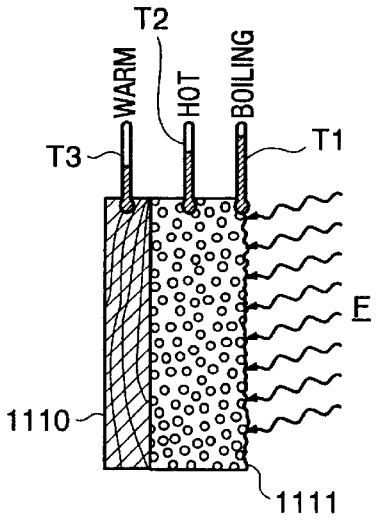
Figure 14:
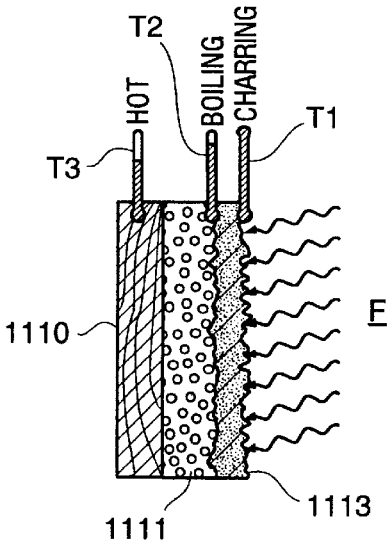
Figure 15:
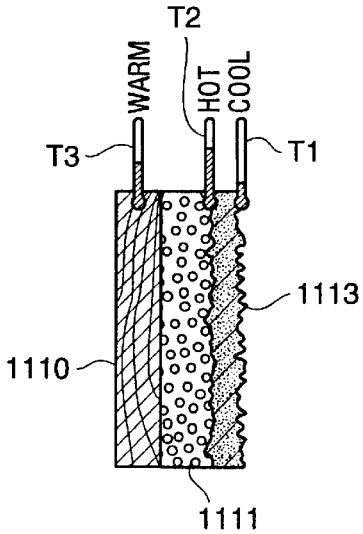
Figure 16:
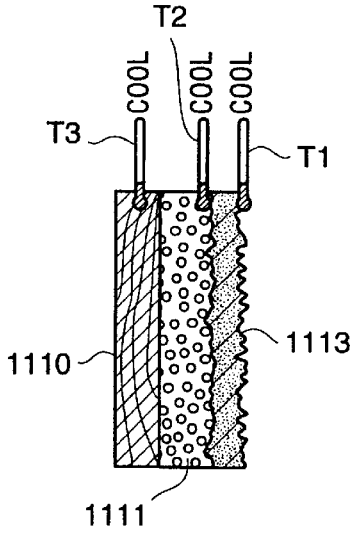

FIG. 12 illustrates the application of extreme heat (solid wavy lines) that is produced by a fire F, such as a wild fire, which produces temperatures in the range of 1300–2400 degrees Fahrenheit. The dotted lines radiating from the surface of the fire fighting foam 1111 represent heat reflected from the surface of the fire fighting foam 1111. As can be seen from the thermometers T1–T3 of FIG. 12 in the second time segment of this temporal sequence, the exposed surface of the fire fighting foam 1111 is subjected to high temperatures produced by the fire F and the low thermal conductivity of the fire fighting foam 1111 transfers only a fraction of the applied heat toward the combustible material 1110. The center of the fire fighting foam 1111 is elevated in temperature from the pre-fire state as shown by thermometer T2, but the combustible material 1110 still is not elevated in temperature as shown by thermometer T3. As shown in FIG. 13 in the third segment of the temporal sequence, as the fire F persists, the surface of the fire fighting foam 1111 boils when subjected to the extreme temperatures of the flames of the fire F since the fire fighting foam 1111 contains water. Steam is produced at the surface of the fire fighting foam 1111 and the interior of the fire fighting foam layer 1111 reaches a high temperature, as illustrated by thermometer T2. The combustible material 1110 is insulated from the extreme temperature of the flames but does rise in temperature as a function of the longevity of the fire F as shown by thermometer T3. FIG. 14 illustrates the next successive temporal view where the side of the fire fighting foam 1111 that is exposed to the fire F dries and turns to char 1113. The foam material therefore acts as a sacrificial material and is slowly consumed by the fire F over time until the fire F passes away from the structure or is extinguished. As can be seen from the thermometers T1–T3, the temperature elevates throughout the various layers (combustible material 1110, foam 1111, char 1113) compared to the previous temporal segments illustrated in FIGS. 11–13. In FIG. 15, the fire F has passed and the layers of material (combustible material 1110, foam 1111, char 1113) begin to cool. The combustible material 1110 remains protected and does not exceed 212 degrees Fahrenheit (thermometer T3) as long as a layer of foam 1111/char 1113 remains. As illustrated in FIG. 16, with the passage of time, the various layers (combustible material 1110, foam 1111, char 1113) return to the ambient temperature and the foam 1111 with its charred surface layer 1113 can be rinsed off with water, leaving the unscathed combustible material 1110 in its original state.

System Architecture

The fire fighting foam generation apparatus that produces the beneficial materials described above is illustrated in block diagram form in FIG. 1 as a full-sized, yet portable system. This apparatus is a completely passive system that does not require the use of electricity or gasoline powered pumps for operation. Therefore, in a wildfire environment, when the power lines are typically down and there is a limited supply of water available for fire fighting purposes, this apparatus provides a unique combination of capabilities that make it ideal for application in this environment.

In the embodiment illustrated in FIG. 1, the water/foam mixture (fire suppressant foam fluid) is stored in a storage tank 103 in premixed form in proportions dictated by the manufacturer of the foam concentrate. A typical foaming material is sold by Chemonics Industries, Inc. under the trade name of "FIRE-TROL® FIREFOAM® 103". This foaming agent (foam concentrate) is a mixture of foaming and wetting agents in a non-flammable solvent. The concentrate is diluted with a fluid, such as water, to produce the water/foam mixture which expands into the resultant fire suppressant product when agitated by a propellant and delivered through an appropriate system of agitators (stata tube), and properly dimensioned pipes or hoses, which further enhances the agitation. In the fire suppressant foam generation apparatus, the propellant consists of the inert gas nitrogen that is stored in a highly pressurized condition in one or more nitrogen bottles 101 which are interconnected via a manifold 102. The output of the nitrogen manifold 102 is applied through a pressure regulator 105 of conventional design to a supply line 106. The supply line 106 can supply one or more foam mixing systems via junction 117 which can lead to a plurality of the apparatus illustrated in FIG. 1. For the purpose of simplicity of illustration, this additional apparatus is not replicated in FIG. 1.

The pressurized nitrogen applied through supply line 106 can be used to power the pressurized gas driven pump 104 or an additional source of pressurized gas, such as air compressor 115, can be used to supply pressurized gas via line 110 to operate the pressurized gas driven pump 104. Alternatively, a hydraulically or mechanically driven pump, such as a power take off (PTO) driven pump, can be used in lieu of the pressurized gas driven pump 104, especially if this apparatus is mounted on a vehicle. If pressurized nitrogen is used to operate pump 104, a tap line 116 draws pressurized nitrogen from supply line 106 and applies it through pressure regulator 107 to the pressurized gas supply intake of pump 104. In either case, whether pressurized air is used from air compressor 115 or pressurized nitrogen from supply line 106, the pressurized gas functions to operate pump 104 to actively draw the water/foam mixture from storage tank 103 via line 109 and output it through check valve 112 at a significantly increased pressure to water/foam mixture volume valve 113. The water/foam mixture volume valve 113 controls the flow of the water/foam mixture to thereby controllably regulate the water/foam and pressurized gas mixture that is provided to create the agitated foam mixture. A propellant supply line 108 is provided to draw the pressurized nitrogen from supply line 106 and apply it via valve 119 to the stata tube 118 where it is mixed with the water/foam mixture output by the water/foam mixture volume valve 113. The stata tube 118 outputs a pressurized expanded foam mixture to outlet line 111 where it is propelled down the length of outlet line 111 by the action of the pressurized nitrogen gas being added thereto via stata tube 118. The fluid flow through stata tube 118 causes the foam material to expand significantly in volume and move rapidly down the outlet line 111 to the spray nozzle 114 that is used by a fire fighter to apply the fire suppressant foam to the object engulfed in flames. The outlet 114 can also be a plurality of sprinkler heads located on the interior or exterior of a structure to provide a passive application of the foam to the object to be protected.

The outlet line 111 is illustrated as a single length of hose, but its implementation can be that of a plurality of lines enclosed in a single outer covering. This implementation provides additional control over the bubble structure of the resultant foam, since bubble structure is a function of the diameter of the outlet line 111. Therefore, to achieve large volume delivery of the generated foam, it may be advantageous to feed the produced foam through multiple lines enclosed in a single sheath.

Stata Tube Apparatus

Figure 2:
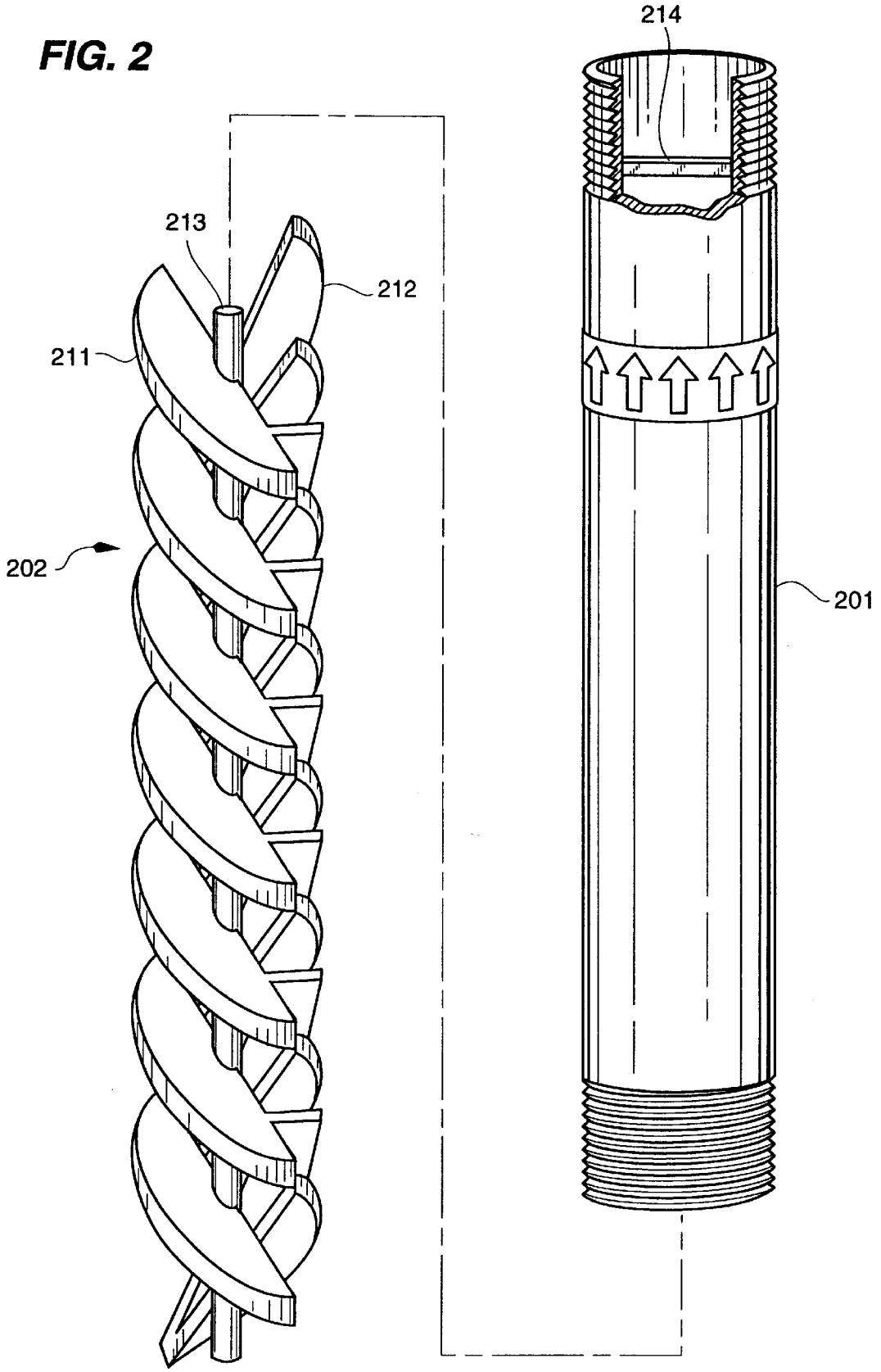
FIG. 2 illustrates a perspective, exploded view of the stata tube foam agitating apparatus.
Figure 3:
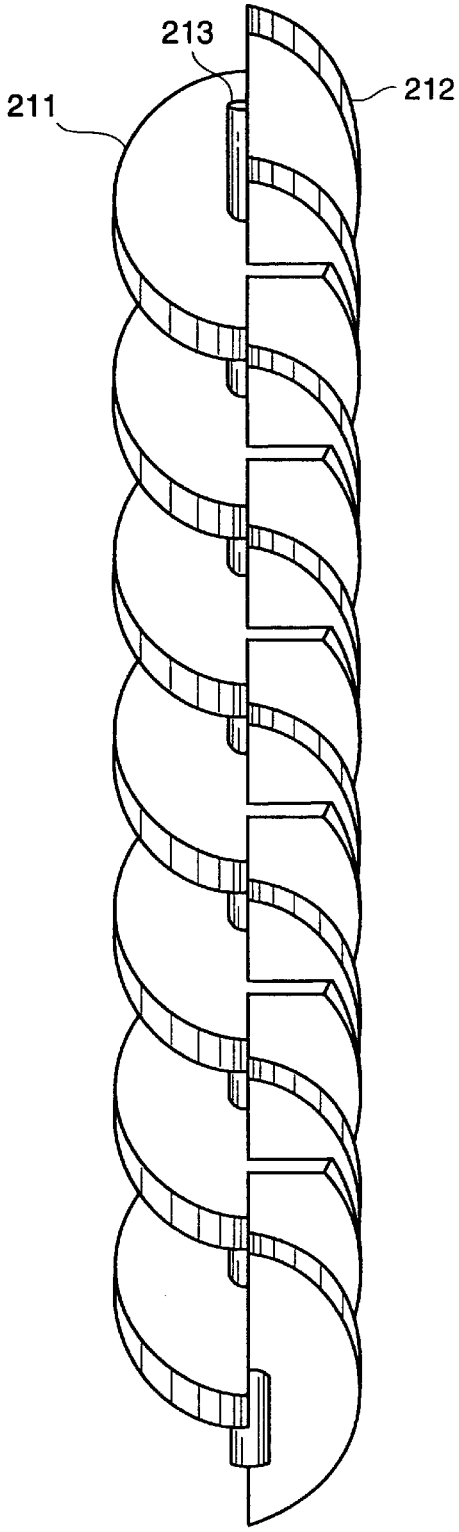
FIGS. 3–4 illustrate perspective views and plan views, respectively of a first embodiment of the foam mixing blades.
Figure 4:
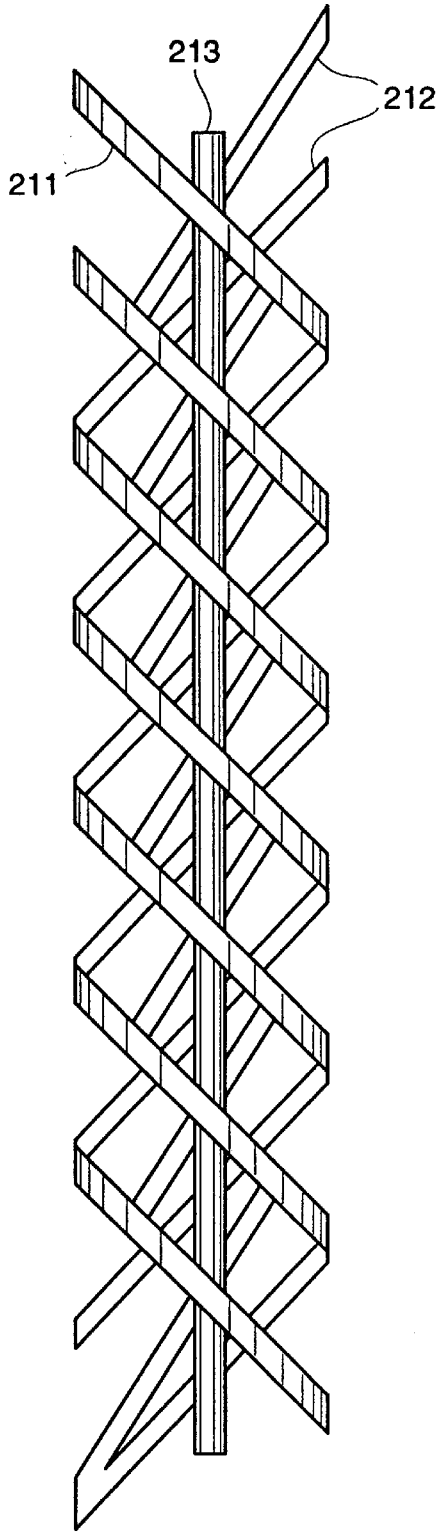
Figure 5:
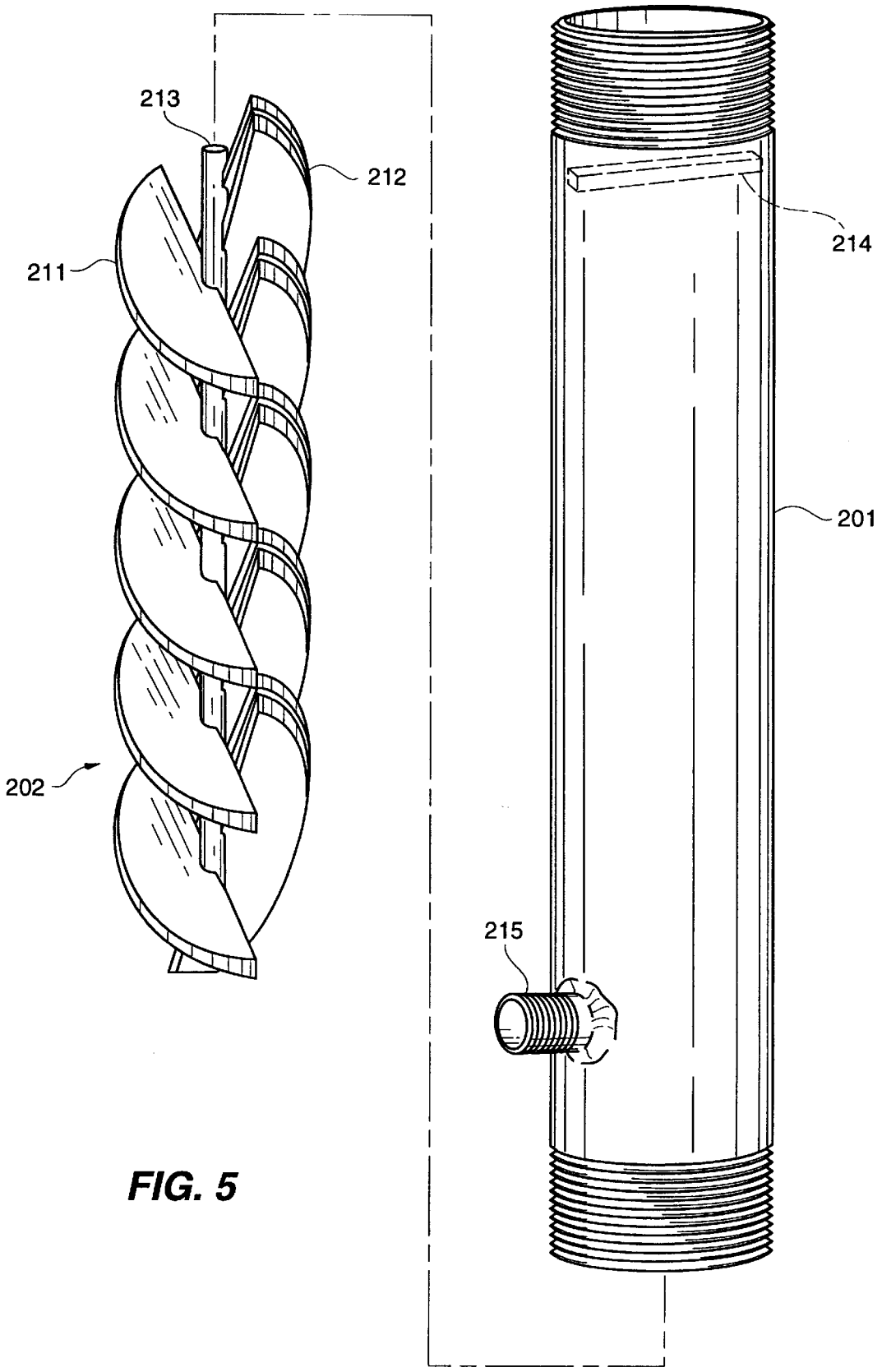
FIG. 5 illustrates a perspective, exploded view of a second embodiment of the stata tube foam agitating apparatus.
Figure 6:
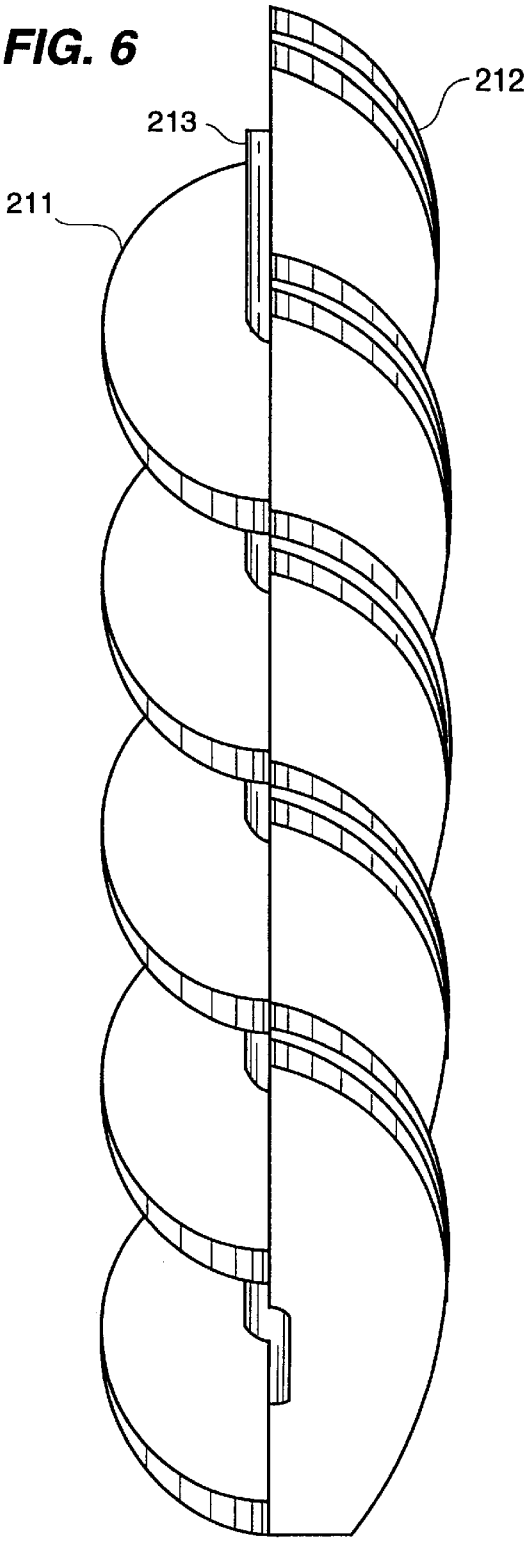
FIGS. 6–7 illustrate perspective views and plan views, respectively of a second embodiment of the foam mixing blades.
Figure 7:
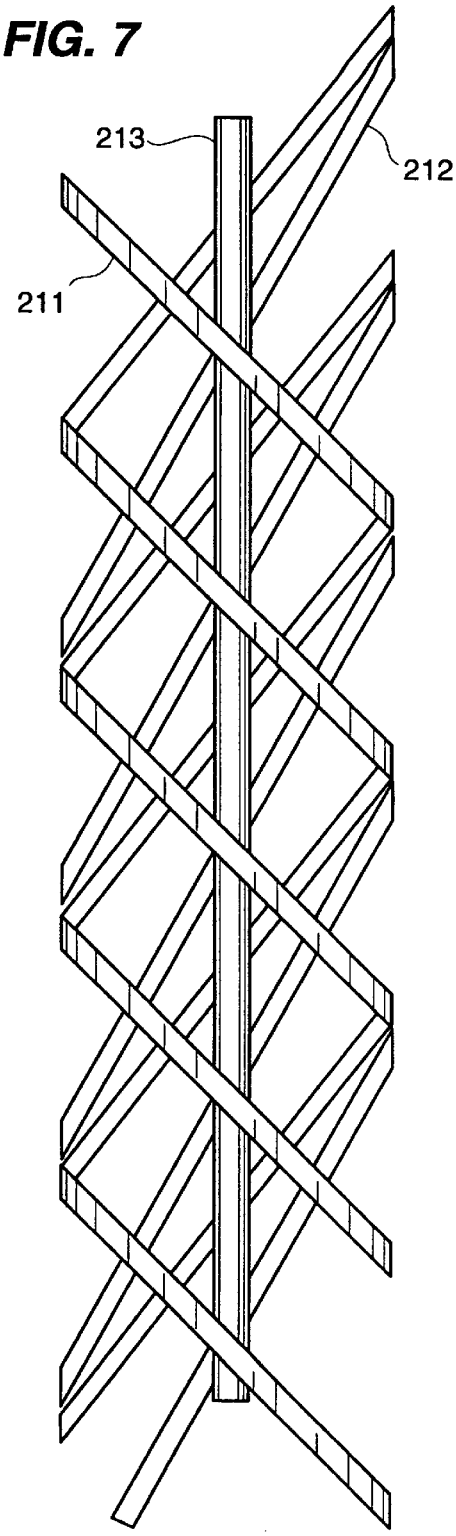

FIGS. 2 and 5 illustrate in perspective, exploded view two embodiments of the stata tube apparatus 118. FIGS. 3–4, 6–7 illustrate perspective views of two embodiments of the mixing blades housed within the stata tube 118. This apparatus comprises an external housing 201 having an interior channel extending form a first end to a second end thereof (with the direction of fluid flow being indicated by the arrows imprinted on exterior housing 201), inside of which is mounted a set of stationary blades 202 which function to mix and agitate the water-foam mixture. The external housing 201 in the preferred embodiment is cylindrical in shape to enable the coaxial mounting of the stata tube 118 interposed between valve 113 and the delivery apparatus, hose 111. The housing 201 is constructed from a durable material, such as stainless steel and, as shown in FIG. 2, is threaded on both ends thereof to enable the simple coupling of the stata tube 118 to the tube 111 and valve 113.

The blades 202 comprise two sets of substantially semi-elliptical blade elements 211, 212, each set comprising a plurality of blade elements. The blade elements 211, 212 are attached to an axially oriented core element 213. A first set of blade elements comprises a plurality (n) of parallel oriented spaced apart blade elements 211 affixed at substantially the midpoint of the straight edge thereof to the core element 213 and aligned at an angle to the length of the core element 213. The second set of blade elements comprises approximately twice the number (m) of blade elements 212 as in the first set of blade elements and are oriented in a zig-zag pattern at an angle to the length of the core element 213. A first subset of the set of blade elements 212 comprises a plurality (m/2) of parallel oriented spaced apart blade elements 212 affixed at substantially the midpoint of the straight edge thereof to the core element 213 and at an angle to the length of the core element 213. The second subset of the set of blade elements 212 comprises a plurality (m/2, or m/2+1, or m/2−1) of parallel oriented spaced apart blade elements 212 affixed at substantially the midpoint of the straight edge thereof to the core element 213 and at an angle to the length of the core element 213. The first and second subsets of blade elements 212 are oriented so that the distal ends of each blade element 212 in a subset are located juxtaposed to the distal ends of adjacent blade elements 212 of the other subset, to form substantially a zig-zag pattern. The blade elements 212 in the first subset of blade elements 212 are oriented substantially orthogonal to the blade elements 211 when mounted on the core element 213. Typically, the number of blade elements in the first set (n) are equal to the number of blade elements in the first subset of the second set (m/2) which is also equal to the number of blade elements in the second subset of the second set (m/2). However, the number of blade elements in each grouping does not necessarily need to be the same as the number of blade elements in the other groupings.

The two sets of blade elements 211, 212 are mounted in external housing 201 in a stationary manner such that the curved side of each blade element 211, 212 snugly fits against the inside surface of the external housing 201. A retainer bar 214 is mounted inside external housing 201 and aligned to span the interior opening of exterior housing 201 substantially along a center line of the diameter of the interior opening, regardless of its geometry. The pressure generated by the foam mixture forces the blades 202 against retainer bar 214. The retainer bar 214 contacts the end of core element 213 and the endmost blade elements 211, 212 to prevent the blades 202 from moving down the length of exterior housing 201 beyond retainer bar 214 and to prevent the rotation of the blades 202 within the exterior housing. This configuration functions to divide the fluid flow through the stata tube 118 into a number of segments, which swirl around the core element 213 as the flow traverses the length of the stata tube 118. This division of the fluid flow and the concurrent swirling action causes the foam/water mix to mix evenly and simultaneously agitate the resultant mixture to cause the foam to expand. The use of the stata tube 118 not only results in a high coefficient of expansion of the foam but it also produces a more consistent bubble structure which enhances both the longevity and adhesion of the foam when applied to a structure.

The stata tube 118 of FIG. 2 differs from that illustrated in FIG. 5 by the presence of gas injector port 215 shown in FIG. 5. As illustrated in FIG. 1, the pressurized gas is injected into the fire suppressant foam fluid that is delivered by pump 104 to stata tube 118. The stata tube 118 of FIG. 2 utilizes an external fixture (not shown) mounted at the point where the fire suppressant foam fluid enters the stata tube 118 while the stata tube 118 of FIG. 5 incorporates this fixture in the form of gas injector port 215 into the basic structure of stata tube 118. The gas injection takes place prior to the fire suppressant foam fluid encountering the blades 202 to thereby enable the pressurized gas to both propel the fire suppressant foam fluid through the stata tube 118 as well as cause expansion of the fire suppressant foam fluid into the resultant fire fighting foam.

Pressurized Gas Operated Pump

Figure 9:
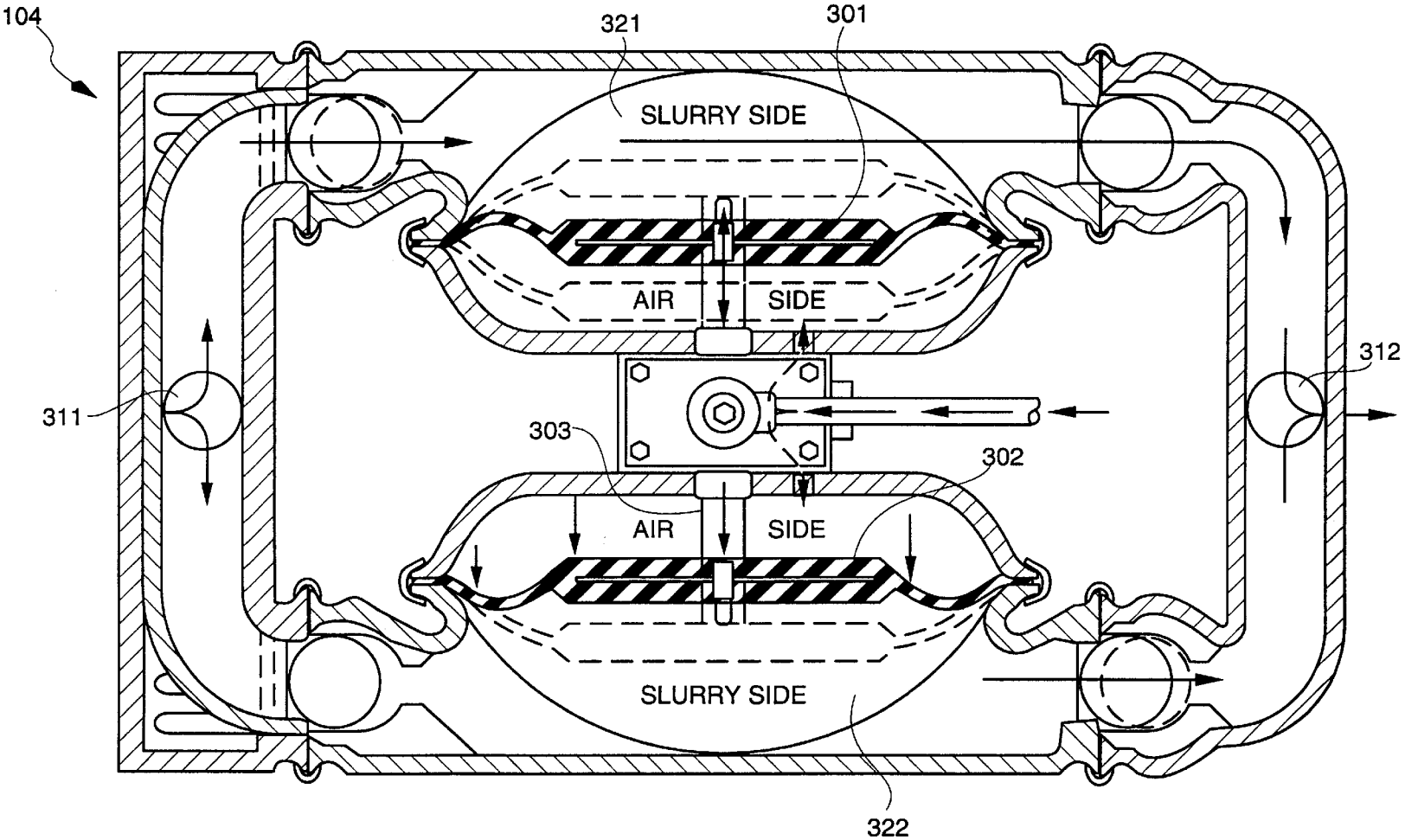
FIG. 9 illustrates a cross-sectional view of a typical pump that can be used in the implementation of this system.

FIG. 9 illustrates a cross-sectional view of a pressurized gas driven pump 104 that is presently available from Wilden Pump and Engineering Company and which is sold under various trade names. One model of Wilden pumps is sold under the trade name CHAMP™ which is an air operated double diaphragm nonmetallic seal-less positive displacement pump. This pump is manufactured from polypropylene, polyvinylidine fluoride and Teflon® materials to provide chemical resistance, excellent mechanical properties and flex fatigue resistance in a lightweight inexpensive package. This pump can pump from 1/10 to 155 gallons/minute. These pumps are self-priming and variable capacity.

In operation, compressed gas is applied directly to the liquid column and is separated therefrom by a pair of elastomer diaphragms 301, 302. The diaphragms 301, 302 operate in opposition to provide a balanced load and create a steady pumping output. The product to be pumped, also called "slurry", is input at an inlet 311 located in the bottom of the pump 104 and drawn up into the liquid chamber by the operation of the diaphragms 301, 302. The two diaphragms 301, 302 are mechanically connected by arm 303 and operated by means of the air pressure supplied by a set of air valves (not shown). When a pressurized diaphragm 302 reaches the full limit of its stroke, forcing the slurry out to the outlet pipe 312 located at the top of the pump 104, an air valve is activated to shift the air supply pressure to the inner side of the opposite diaphragm 301. Meanwhile, when the pressurized diaphragm 302 is going through its active stroke, the other diaphragm 301 is being drawn inward, creating a suction to draw slurry into the liquid chamber 321 through the pump inlet 311. Check valves located in the pump inlet 311 and outlet 312 prevent a back flow between the diaphragms 301, 302 caused by the sequential operation of the two diaphragms 301, 302. Thus, the two diaphragms 301, 302 are cooperatively operative to create a suction in one fluid chamber 321 while pressurizing the second fluid chamber 322 to output a flow of the slurry. Simple air valves shift the pressurized gas to one or the other diaphragms 301, 302 dependent on the position of the diaphragms 301, 302 in their range of motion. The pump 104 can be operated by means of the pressurized nitrogen or by an auxiliary source of pressurized gas, such as a portable air compressor 115. In either case, the water/foam mixture is actively drawn from the supply tank 103 and output through a check valve 112 in a pressurized condition by the operation of pump 104.

Permanently Installed Delivery Systems

Figure 10:
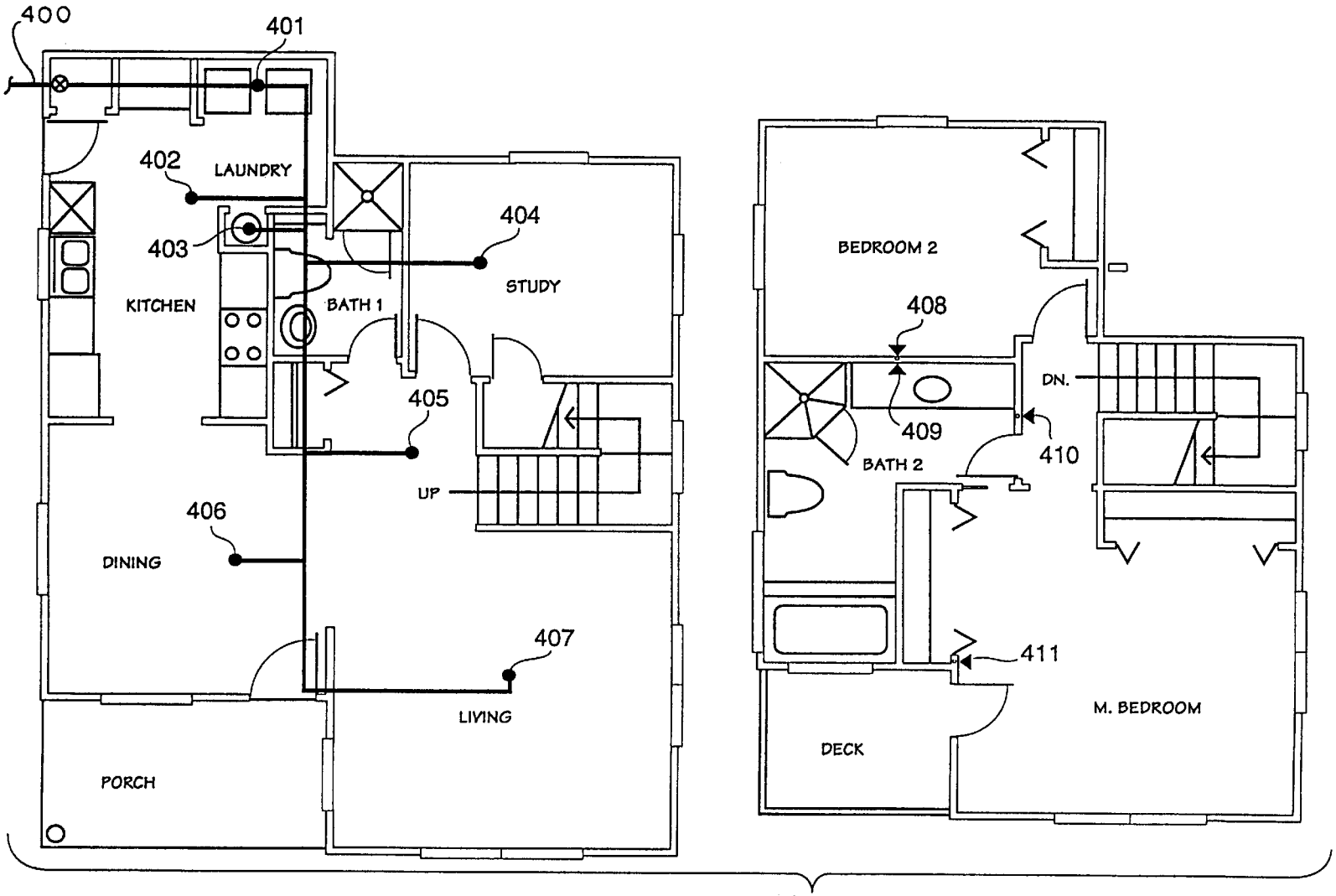
FIG. 10 illustrates a diagram of a residential installation of the fire suppressant foam generation apparatus of the present invention.

In addition to use with a manual delivery system as described above, the fire suppressant foam generation apparatus can be used with a permanently installed delivery system similar to conventional sprinkler systems used in residential and commercial buildings. An example of a typical residential sprinkler system is shown in FIG. 10 wherein a two-story residential structure has seven sprinkler heads 401–407 installed in the 717 square foot first floor of the structure and four additional sprinkler heads 408–411 installed in the 574 square foot second floor of the structure. Using standard design criteria for fire sprinkler systems, a flow rate of approximately 65 gallons of water per minute is required for effective fire fighting in such a system. It is obvious that this installation would be impractical in a wildland/urban interface environment since this volume of water is typically unavailable. In operation, this flow of water also causes a significant amount of water damage to the contents of the structure and also some damage to the structure itself if left in operation for a significant amount of time.

The water/foam mixture volume valve 113 in the fire suppressant foam generating apparatus is used to regulate the moisture content of the resultant fire retardant foam that is produced. The water damage that results from dispensing fire retardant foam from the residential sprinkler system is thereby significantly reduced. The reduction of water damage is especially important in a business environment where numerous paper records are maintained. Therefore, the inlet 400 of the sprinkler system illustrated in FIG. 10 can be connected to outlet pipe 111 of the fire suppressant foam generation apparatus to obtain the benefits of the use of a low moisture content fire suppressant foam in a conventional residential fixed installation sprinkler system.

Backpack Unit

Figure 8:
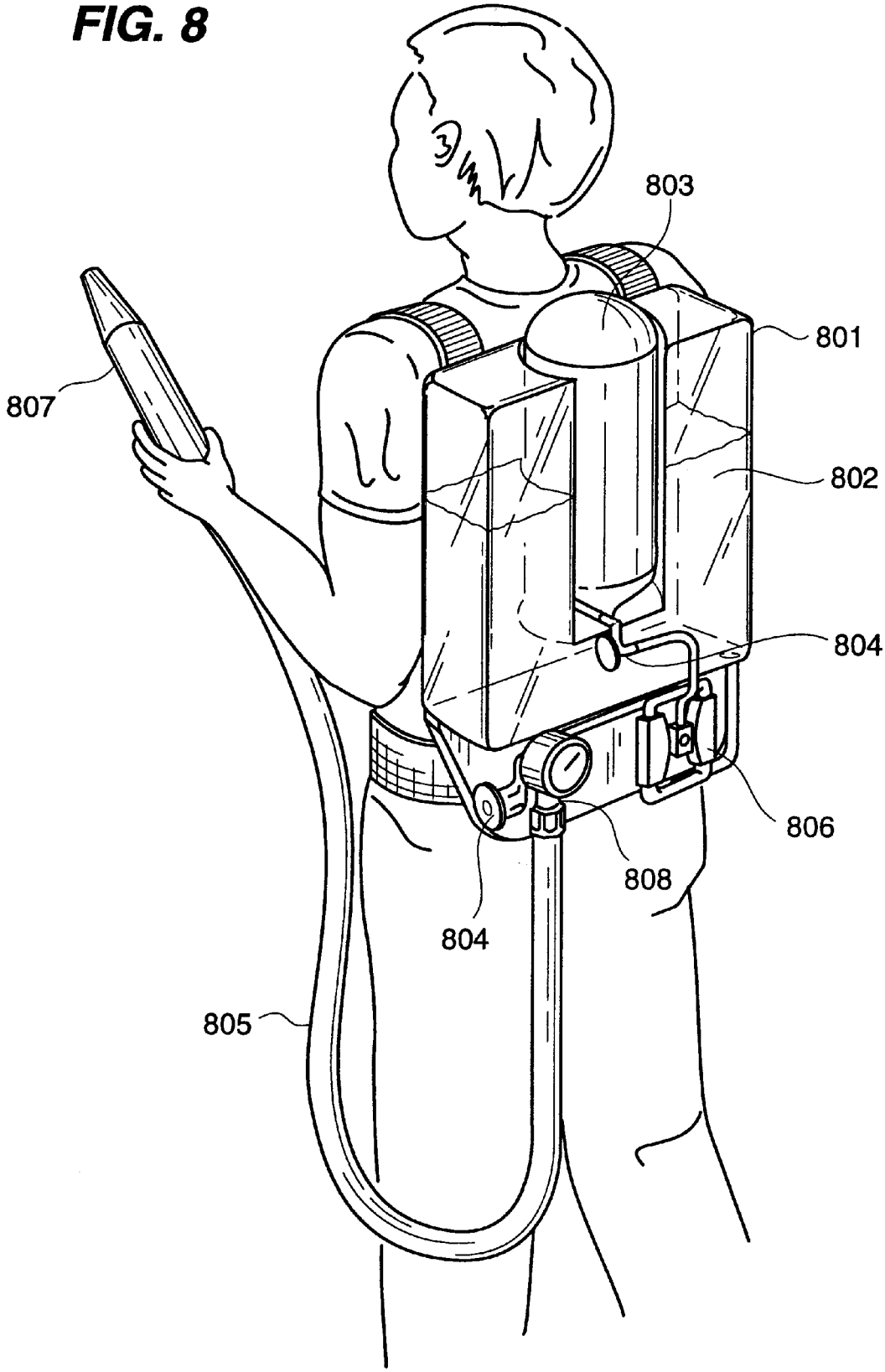
FIG. 8 illustrates a perspective view of a backpack embodiment of the fire suppressant foam generation apparatus of the present invention.

FIG. 8 illustrates in perspective view a backpack embodiment of the fire suppressant foam generation apparatus of the present invention. This apparatus represents a scaled down version of the basic fire suppressant foam generation apparatus that is illustrated in FIG. 1. The backpack unit is intended for use by both professional fire fighters and laypersons. This unit is especially beneficial for smoke jumpers to fight spot fires in the forests; rural fire departments, farmers and ranchers for weed fires; and all fire fighters for structure fires. The unit consists of a storage tank, shown formed as a substantially U-shaped molded element 801, which contains the liquid foam concentrate/water mixture 802. A high pressure tank 803 containing pressurized gas, either nitrogen or a nitrogen-air mixture, or other suitable gas mixture, is included as shown in an aperture formed in the housing 801. The storage tank 801 and high pressure tank 803 are both connected to the control valves and regulator elements 804, with a miniature double diaphragm pump 806 being provided as with the system of FIG. 1. A short length of hose 805 with its attached nozzle 807, connected to stata tube 808, are provided to enable the fire fighter to apply the generated foam to the fire.

An optional mouthpiece can be provided if the unit is charged with a breathable gas mixture in the high pressure tank 803, so the unit can perform a dual function of fire fighting foam generation apparatus as well as an emergency breathing system. The dimensions of all the apparatus in the backpack unit are proportionally scaled down from the full-sized system of FIG. 1 and provides an additional benefit of generating a more uniform bubble structure that the full size unit of FIG. 1 due to the smaller diameter delivery apparatus, comprising the stata tube 808, hose 805 and nozzle 807. This resultant bubble structure produces a foam which lasts a long time and adheres to vertical surfaces exceptionally well.

Summary

In summary, the fire suppressant foam generation and application apparatus produces a low moisture content fire suppressant foam mixture for use in fire fighting applications. The reduction in the water content of the fire suppressant foam is accomplished by the use of pressurized gas in place of water and the use of a stata tube to create the agitation and pressurized delivery capability. Furthermore, the use of the pressurized nitrogen eliminates the need for a large complex pumping apparatus to pump an incompressible fluid, such as water, that has been used in the past to agitate and supply the foam mixture to the spray nozzles. A pressurized gas operated pump can be used to actively draw the water/foam mixture from a supply tank and supply it under pressure to the outlet line where it is mixed with and agitated by the pressurized nitrogen to create the resultant foam.

I claim:

1. Apparatus for generating fire suppressant foam comprising:

a backpack;

a source of fire suppressant foam fluid mounted on said backpack;

a source of pressurized gas mounted on said backpack;

means for producing a flow of said fire suppressant foam fluid from said source of said fire suppressant foam fluid;

means for injecting a flow of said pressurized gas into said flow of said fire suppressant foam fluid to create the fire suppressant foam;

means for expanding the fire suppressant foam; and means for delivering the fire suppressant foam.

2. The apparatus of claim 1 wherein said source of said pressurized gas comprises at least one container of pressurized substantially inert gas.

3. The apparatus of claim 1 wherein said pressurized gas comprises nitrogen.

4. The apparatus of claim 1 wherein said means for producing said flow of said fire suppressant foam fluid comprises:

means for drawing a controllable flow of said fire suppressant foam fluid from said source of fire suppressant foam fluid.

5. The apparatus of claim 4 wherein said drawing means comprises a pressurized gas operated pump.

6. The apparatus of claim 1 wherein said means for expanding comprises:

an exterior housing having an interior channel formed therein from a first end connected to said means for producing the flow of said fire suppressant foam fluid to a second end connected to said means for delivering, thereby forming a fluid path from said means for producing the flow of said fire suppressant foam fluid to said means for delivering through said interior channel; and stationary blade means mounted in said interior channel for agitating said fire suppressant foam fluid as it traverses said interior channel from said first end to said second end to produce said fire suppressant foam prior to output to said means for delivering.

7. The apparatus of claim 6 wherein said stationary blade means comprises:

a core element aligned substantially along a lengthwise axis of said interior channel; and a plurality of blade elements, each affixed to said core element and extending to an interior surface of said interior channel for forming a plurality of fluid paths extending substantially from said first end to said second end of said exterior housing.

8. The apparatus of claim 7 wherein said plurality of blade elements comprises:

n substantially semi-elliptically shaped elements aligned in a parallel oriented succession of blade elements mounted on a first side of said core element, wherein n is a positive integer greater than 1; and m substantially semi-elliptically shaped elements aligned in a zig-zag oriented succession of blade elements mounted on a second side of said core elements opposite said first side, wherein m is a positive integer greater than 1.

9. The apparatus of claim 8 wherein said source of said fire suppressant foam fluid comprises a backpack mountable storage tank and said source of said pressurized gas comprises a high pressure tank mounted with said storage tank.

10. The apparatus of claim 1 wherein said source of said fire suppressant foam fluid comprises a storage tank containing a mixture of fire suppressant foam concentrate and a fluid.

11. A method for generating fire suppressant foam using apparatus comprising a backpack, a source of fire suppressant foam fluid mounted on said backpack, and a source of pressurized gas mounted on said backpack, said method comprising the steps of:

producing a flow of said fire suppressant foam fluid from said source of said fire suppressant foam fluid;

injecting a flow of said pressurized gas into said flow of said fire suppressant foam fluid to create the fire suppressant foam;

expanding the fire suppressant foam; and delivering the fire suppressant foam via a delivery system.

12. The method of claim 11 wherein said step of producing comprises:

drawing, via a pump, a controllable flow of said fire suppressant foam fluid from said source of said fire suppressant foam fluid.

13. The method of claim 11 wherein said step of expanding comprises:

forming a fluid path from said source of said fire suppressant foam fluid to said delivery system through an exterior housing having an interior channel formed therein from a first end connected to said source of said fire suppressant foam fluid to a second end connected to said delivery system; and agitating said fire suppressant foam fluid as it traverses said interior channel to produce said fire suppressant foam.

14. The method of claim 13 wherein said step of agitating comprises:

forming a plurality of fluid paths extending substantially from said first end to said second end of said exterior housing using a core element aligned substantially along a lengthwise axis of said interior channel, and a plurality of blade elements, each affixed to said core element and extending to an interior surface of said interior channel of said exterior housing.

15. The method of claim 11 wherein said method comprises the step of:

mounting a storage tank containing a mixture of fire suppressant foam concentrate and a fluid on said backpack to create said source of said fire suppressant foam fluid.

* * * * *